US009296035B2

(12) United States Patent
Horaguchi et al.

(10) Patent No.: US 9,296,035 B2
(45) Date of Patent: Mar. 29, 2016

(54) LUBRICATING-OIL COMPOSITION FOR FORGING MOLDING AND FORGING MOLDING APPARATUS

(75) Inventors: Norihisa Horaguchi, Tokyo (JP); Kosuke Ikeda, Tokyo (JP); Masaru Seto, Osaka (JP); Yuusuke Sakama, Osaka (JP)

(73) Assignees: MITSUBISHI HEAVY INDUSTRIES, LTD., Tokyo (JP); SATO SPECIAL OIL, LTD., Osaka-shi, Osaka (JP)

( * ) Notice: Subject to any disclaimer, the term of this patent is extended or adjusted under 35 U.S.C. 154(b) by 819 days.

(21) Appl. No.: 13/498,239

(22) PCT Filed: Sep. 30, 2010

(86) PCT No.: PCT/JP2010/005898

§ 371 (c)(1),
(2), (4) Date: Apr. 19, 2012

(87) PCT Pub. No.: WO2011/048754

PCT Pub. Date: Apr. 28, 2011

(65) Prior Publication Data

US 2012/0192609 A1 Aug. 2, 2012

(30) Foreign Application Priority Data

Oct. 23, 2009 (JP) ..... 2009-244397

(51) Int. Cl.
*C10M 147/02* (2006.01)
*B21J 3/00* (2006.01)
(Continued)

(52) U.S. Cl.
CPC ... *B21J 3/00* (2013.01); *B21K 3/00* (2013.01); *B21K 13/02* (2013.01); *B21K 29/00* (2013.01);
(Continued)

(58) Field of Classification Search
CPC ..... C10M 2211/06; C10M 2213/062; C10N 2020/06; C10N 2040/02; C10N 2040/24; C10N 2240/40; C10N 2040/402; C10N 2240/58
USPC ..... 508/181, 183
See application file for complete search history.

(56) References Cited

U.S. PATENT DOCUMENTS 4,284,519 A * 8/1981 Reick ..... 508/117
5,059,334 A * 10/1991 Scheld ..... 508/181
(Continued)

FOREIGN PATENT DOCUMENTS

CN 1938410 A 3/2007
CN 101541936 A 9/2009
(Continued)

OTHER PUBLICATIONS

Notification of Transmittal of Translation of the International Preliminary Report on Patentabililty (Form PCT/IB/338) of International Application No. PCT/JP2010/005898 mailed May 24, 2012 with Forms PCT/IB/373 and PCT/ISA/237 (8 pages).
(Continued)

*Primary Examiner* — Ellen McAvoy
(74) *Attorney, Agent, or Firm* — Westerman, Hattori, Daniels & Adrian, LLP

(57) ABSTRACT

An object is to provide a lubricating-oil composition for forging molding excellent in lubricity, and a forging molding apparatus also suitable for the lubricating-oil composition of the present invention.
The lubricating-oil composition for forging molding of the present invention includes at least two types of solid lubricants having different particle sizes, an extreme-pressure agent, and the balance of base oil. Also, the forging molding apparatus of the present invention includes paired molds formed of an upper mold and a lower mold interposing a forging material therebetween for molding and a lubricating-oil-composition spraying device for spraying the lubricating-oil composition for forging molding onto a surface of the molds, wherein the spraying device includes an oil-feeding tank storing the lubricating-oil composition and a supply tube for suctioning the lubricating-oil composition from the oil-feeding tank for supply to a nozzle, and the supply tube comprises a plurality of suction ports.

5 Claims, 7 Drawing Sheets

(51) Int. Cl.

| | |
|---|---|
| ***B21K 3/00*** | (2006.01) |
| ***B21K 13/02*** | (2006.01) |
| ***B21K 29/00*** | (2006.01) |
| ***C10M 141/10*** | (2006.01) |
| ***C10M 161/00*** | (2006.01) |
| ***C10M 169/04*** | (2006.01) |

(52) U.S. Cl.

CPC ..... *C10M 141/10* (2013.01); *C10M 161/00* (2013.01); *C10M 169/04* (2013.01); *C10M 2203/1006* (2013.01); *C10M 2205/026* (2013.01); *C10M 2207/40* (2013.01); *C10M 2213/062* (2013.01); *C10M 2223/045* (2013.01); *C10N 2220/082* (2013.01); *C10N 2230/06* (2013.01); *C10N 2240/402* (2013.01)

(56) References Cited

U.S. PATENT DOCUMENTS

| | | | | |
|---|---|---|---|---|
| 5,160,646 | A * | 11/1992 | Scheld | 508/183 |
| 5,554,308 | A * | 9/1996 | Masaie et al. | 508/181 |
| 5,624,887 | A * | 4/1997 | Nakamaru et al. | 508/108 |
| 5,744,539 | A * | 4/1998 | McCoy et al. | 524/546 |
| 5,990,054 | A * | 11/1999 | Willis | 508/182 |
| 6,211,121 | B1 * | 4/2001 | Willis | 508/181 |
| 6,255,260 | B1 * | 7/2001 | Stork | 508/421 |
| 6,335,309 | B1 * | 1/2002 | Takagi et al. | 508/115 |
| 6,358,891 | B1 * | 3/2002 | Andersen | 508/151 |
| 6,455,476 | B1 * | 9/2002 | Imai et al. | 508/156 |
| 6,555,648 | B1 | 4/2003 | Hinds | |
| 7,143,812 | B2 * | 12/2006 | Bahaychick et al. | 164/472 |
| 7,625,850 | B2 * | 12/2009 | Horaguchi et al. | 508/485 |
| 7,939,605 | B2 * | 5/2011 | Lehmann | 525/326.3 |
| 8,283,296 | B2 * | 10/2012 | Hugues et al. | 508/113 |
| 2008/0090740 | A1 | 4/2008 | Hugues et al. | |
| 2008/0234150 | A1 | 9/2008 | Kakizaki et al. | |
| 2011/0045309 | A1 * | 2/2011 | Reusmann et al. | 428/457 |
| 2011/0165331 | A1 * | 7/2011 | Barth et al. | 427/406 |

FOREIGN PATENT DOCUMENTS

| | | | |
|---|---|---|---|
| JP | 51-026906 | A | 3/1976 |
| JP | 02-248497 | A | 10/1990 |
| JP | 07-292381 | A | 11/1995 |
| JP | 09-040988 | A | 2/1997 |
| JP | 2000-136397 | A | 5/2000 |
| JP | 3475983 | B2 | 12/2003 |
| JP | 2010-174204 | A | 8/2010 |
| WO | 2008/045647 | A1 | 4/2008 |

OTHER PUBLICATIONS

International Search Report for PCT/JP2010/005898, dated Dec. 28, 2010.

Chinese Office Action dated Dec. 28, 2012, issued in corresponding Chinese Patent Application No. 201080040867.X, with English translation (11 pages).

Extended European Search Report dated May 7, 2013, issued in corresponding European Patent Application No. 10824609.1 (5 pages).

* cited by examiner

LUBRICATING-OIL COMPOSITION FOR FORGING MOLDING AND FORGING MOLDING APPARATUS

TECHNICAL FIELD

The present invention relates to a lubricating-oil composition for forging molding to be used for reducing friction between a mold and a molded body in forging molding. Also, the present invention relates to a forging molding apparatus suitable for forging molding using the lubricating-oil composition for forging molding.

BACKGROUND ART

A scroll is used in a compressor or the like configuring an air conditioning apparatus. This scroll has been manufactured mainly by casting, machining, or the like. In recent years, however, in order to increase productivity, strength or the like, scrolls are often manufactured by forging molding with the use of molds.

In a field of forging molding of an aluminum alloy, an iron alloy or the like, in order to reduce friction between a forging material and a mold, it is general to perform forging molding by interposing a lubricant between the forging material and the mold.

As the lubricant for forging molding, a graphite-based lubricant or a non-graphite-based lubricant is used.

The graphite-based lubricant has high lubricity at low cost, but the flash point of the base oil in which graphite is dispersed is 170° C. to 200° C., and therefore this lubricant has a danger of fire. Also, due to graphite contamination of the working environment there is a disadvantageous possibility of a health damage on human bodies.

By contrast, the non-graphite-based lubricant has a high flash point equal to or higher than approximately 270° C., and therefore a danger of fire is low. Since graphite is not used, safety of human bodies is high. However, the non-graphite lubricant has a problem of high cost and low lubricity compared with the graphite-based lubricant. When forging molding are performed by using a lubricant with low lubricity, the following three problems arise. Firstly, molding yields are decreased due to sticking to a mold or poor molding. Secondly, although a simple shape can be molded, it is difficult to mold a complex shape such as a scroll. Thirdly, the life of the mold is shortened.

Because of these problems, as a lubricant that can be used for forging molding, a lubricant for forging molding has been demanded, which is a safe non-graphite-based lubricant without graphite contamination of the working environment and has lubricity equivalent to or higher than that of a graphite-based lubricant.

Patent Document 1 discloses a non-graphite-based lubricant for a plunger-chip with improved lubricity, which is obtained by adding one or more types of oil, fatty acid, and fatty ester, a solid lubricant, and a surfactant to base oil made of mineral oil.

However, the lubricant disclosed in Patent Document 1 is a lubricant for casting and is not for forging molding, and no non-graphite-based lubricant having lubricity suitable for forging molding has been found yet now.

CITATION LIST

Patent Document

Patent Document 1: Japanese Patent Laid-Open No. 2-248497

SUMMARY OF THE INVENTION

Technical Problems to be Solved by the Invention

The present invention was made in view of these technical problems, and has an object of providing a lubricating-oil composition for forging molding excellent in lubricity. Also, an object is to provide a forging molding apparatus also suitable for the lubricating-oil composition for forging molding of the present invention.

Solution to the Problems

With this object, the inventors added various substances to base oil to diligently study improvements in lubricity. As a result, the inventors have found that, by adding solid lubricants having different particle sizes and an extreme-pressure agent to base oil, a lubricating-oil composition for forging molding having lubricity equal to or higher than lubricity of a graphite-based lubricant can be obtained.

Therefore, the present invention is directed to a lubricating-oil composition for forging molding including at least two types of solid lubricants having different particle sizes, an extreme-pressure agent, and the balance of base oil.

The lubricating-oil composition for forging molding of the present invention preferably comprises 0.1 wt % to 15 wt % of the solid lubricants, 5 wt % to 15 wt % of the extreme-pressure agent, and the balance of base oil. Also, the lubricating-oil composition for forging molding preferably comprises 4 wt % to 15 wt % of the solid lubricants, 5 wt % to 15 wt % of the extreme-pressure agent, and the balance of base oil. In the present invention, the composition may comprises 5 wt % or less of a dispersant.

In the present invention, the solid lubricants preferably comprises fluororesin, and the extreme-pressure agent preferably comprises zinc dialkyl dithio phosphate.

Also, in the present invention, when particle sizes of the solid lubricants are selected, among said at least two types of solid lubricants having different particle sizes, at least one type of solid lubricant preferably has a particle size smaller than a minimum surface roughness of a forging material.

Furthermore, in the present invention, the solid lubricants are preferably formed of a polytetrafluoroethylene having a particle size equal to or smaller than 6 μm and a polytetrafluoroethylene having a particle size exceeding 6 μm and equal to or smaller than 15 μm.

The inventors also provide a forging molding apparatus suitable for using the lubricating-oil composition for forging molding of the present invention.

That is, the forging molding apparatus of the present invention includes paired molds formed of an upper mold and a lower mold interposing a forging material therebetween for molding and a lubricating-oil-composition spraying device for spraying the lubricating-oil composition for forging molding of the present invention onto a surface of the molds, wherein the lubricating-oil-composition spraying device includes an oil-feeding tank storing the lubricating-oil composition for forging molding and a supply tube for suctioning the lubricating-oil composition for forging molding from the oil-feeding tank for supply to a nozzle, and the supply tube is provided with a plurality of suction ports.

In the forging molding apparatus of the present invention, the lubricating-oil-composition spraying device preferably includes a plurality of nozzles injecting the lubricating-oil composition for forging molding toward a surface of the molds.

Advantageous Effects of Invention

According to the present invention, a lubricating-oil composition for forging molding excellent in lubricity can be obtained. With this, even a complex shape such as a scroll can be manufactured by forging molding. Also, molding yields are improved, and the life of the molds can be extended.

Also, by using a molding and forging apparatus suitable for the lubricating-oil composition for forging molding of the present invention, it is possible to spray the lubricating-oil composition for forging molding having uniform components onto the mold, and forging molding of various shapes from a simple shape to a complex shape can be performed.

DESCRIPTION OF EMBODIMENTS

Figure 1A:
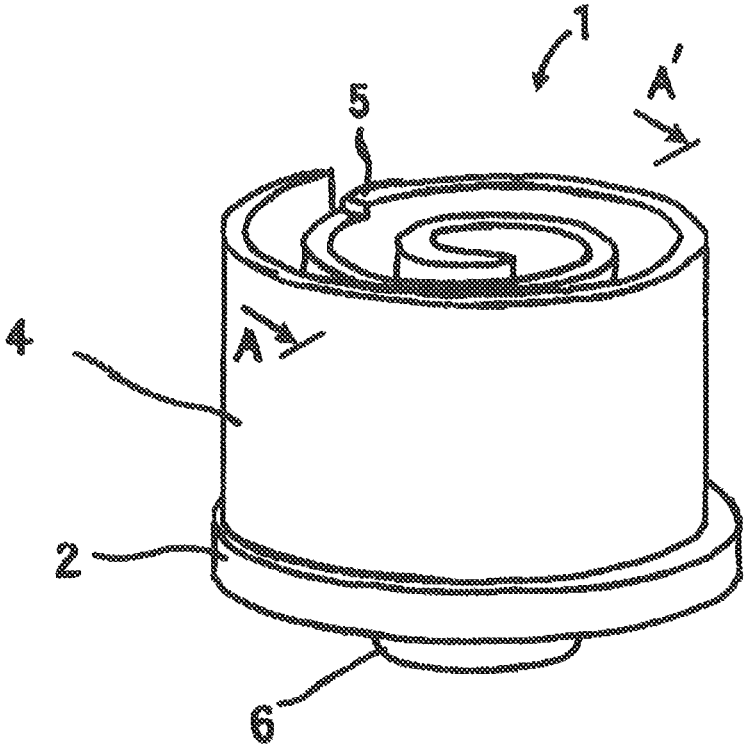
FIG. 1A is a perspective view showing the shape of a scroll.

The lubricating-oil composition for forging molding of the present invention is described in detail below.

<Solid Lubricants>

The lubricating-oil composition for forging molding of the present invention includes at least two types of solid lubricants having different particle sizes. While solid lubricants have an effect of decreasing a friction coefficient serving as an index of lubricity, the effect of decreasing the friction coefficient is not sufficient when a solid lubricant having a single particle size is added. By adding solid lubricants having two or more types of particle sizes, a more sufficient effect can be obtained.

As solid lubricants, the following can be used: fluororesin, molybdenum disulfide, tungsten disulfide, graphite, graphite fluoride, boron nitride, melamine resin, polypropylene resin, polyethylene resin, copper, lead oxide, calcium fluoride, and others. Among these, fluororesin is preferably used. Of fluororesins, polytetrafluoroethylene (hereinafter referred to as PTFE) is most preferable.

0.1 wt % or less solid lubricants does not sufficiently achieve an effect of improving lubricity, and the effect of improving lubricity is saturated when they exceed 15%. Therefore, the solid lubricants are preferably added in a range of 0.1% to 15%. With 4% or more solid lubricants, a more excellent effect of improving lubricity can be obtained. Therefore, 4% to 15% solid lubricants are more preferably added. Since cost increases with the increase in addition amount of the solid lubricants, in order to suppress cost while obtaining the effect of improving lubricity, a range of 4% to 10% is further preferable.

The solid lubricants having two or more types of different particle sizes can be used. While the particle sizes are not restrictive, they can be selected with reference to the surface roughness of the forging material or the molds.

When the surface roughness of the forging material is used as a reference, a solid lubricant having a particle size smaller than a minimum roughness of the forging material is preferably selected as a first solid lubricant. As a second solid lubricant, a solid lubricant having a particle size larger than that of the first solid lubricant can be selected. However, the particle size of the second solid lubricant may be larger than a maximum roughness of the forging material or may be in a range between a minimum roughness value and a maximum roughness value. Also when the surface roughness of the molds is used as a reference, a selection can be made by using a technique similar to that for the surface roughness of the forging material.

When PTFE particles are used as solid lubricants, the PTFE particles easily settle if the particle size exceeds 15 μm, and secondary agglomeration may occur at the time of spraying onto the mold. Therefore, PTFE particles having a particle size equal to or smaller than 15 μm and equal to or larger than 0.1 μm are preferably used. When secondary agglomeration occurs, it is preferable to sufficiently stir the lubricating-oil composition for forging molding before spraying onto the forging molding mold to make its components uniform.

In the present invention, as solid lubricants, most preferably, a PTFE having a particle size equal to or smaller than 6 μm and a PTFE having a particle size exceeding 6 μm and equal to or smaller than 15 μm are mixed for use.

When two types having different particle sizes are used, if the mixing ratio of the solid lubricants is such that a ratio between the first solid lubricant and the second solid lubricant is 20:80 to 80:20 in weight ratio, more preferably 30:70 to 70:30, the friction coefficient is decreased and lubricity is improved.

Although two types of solid lubricants having different particle sizes can be used, three or more types can be combined to obtain the effect of decreasing the friction coefficient.

Also, in the present invention, the particle size is indicated by a value obtained by measurement with a dry laser method (50 weight % average particle size). However, as to those easy to crush by strong shearing, the particle sizes thereof are obtained by observing an electron microscope (SEM) image.

<Extreme-Pressure Agent>

To the lubricating-oil composition for forging molding of the present invention, an extreme-pressure agent for decreasing the friction coefficient is added. As an extreme-pressure agent, the following can be used: zinc dialkyl dithio phosphate, tricresyl phosphate, lauryl acid phosphate, trioctyl phosphate, trixylenyl phosphate, diphenyl phosphate, 2-ethyl hexyl phosphate, molybdenum dialkyl dithio phosphoric ester, tributyl phosphite, dilauryl phosphite, 2-ethyl hexyl phosphite, triphenyl phosphite, diphenyl phosphite, zinc diallyl dithio phosphate, amine salt of phosphoric ester, zinc dialkyl dithio carbamic acid, lead naphthenic acid, Mo-dialkyl dithio carbamates, phosphoric ester (TCP, TPP, TOP, CDP, TXP, and TBP), thio phosphate, or sulfurized oil groups (terpene sulfide) can be used. Among these, zinc dialkyl dithio phosphate (hereinafter may be referred to as Zn-DTP in some cases) is most preferable. The carbon number of the alkyl group configuring zinc dialkyl dithio phosphate is preferably an integer selected from 8 to 12. Note that an oil product or a friction-preventive agent may be contained as an extreme-pressure agent in the present invention.

When the amount of the extreme-pressure agent is less than 5 wt %, the effect of improving lubricity is not sufficiently obtained. When it exceeds 15%, the effect of improving lubricity is saturated. Therefore, the extreme-pressure agent is preferably added in a range of 5% to 15%.

<Base Oil>

The lubricating-oil composition for forging molding of the present invention contains base oil. As the base oil, one or more types can be selected from mineral oil, vegetable oil, synthetic oil, and others. In view of fire prevention, one having a flash point equal to or higher than 200° C. is preferable.

The addition amount of the base oil can be the remainder other than the solid lubricants and the extreme-pressure agent.

<Other Additives>

The lubricating-oil composition for forging molding of the present invention is allowed to contain an additives other than the solid lubricants, the extreme-pressure agent, and the base oil within a range in which the effect of decreasing the friction coefficient of the present invention is not inhibited. As the additive, a dispersant, an antifoaming agent, a thickener, an anticorrosive, an antioxidizing agent, a thermal stabilizer, or others can be used. For example, for the purpose of preventing agglomeration of the solid lubricants, a dispersant such as polyisobutylene (hereinafter referred to as PIB) may be added in a range equal to 5% or less.

The lubricating-oil composition for forging molding of the present invention is suitable for forging molding, such as cold forging molding, warm forging molding and other of aluminum, an aluminum alloy, an iron alloy, and others.

A forging molding apparatus for a scroll made of an aluminum alloy suitable for the lubricating-oil composition for forging molding of the present invention is described in detail below based on an embodiment shown in the attached drawings.

Figure 1B:
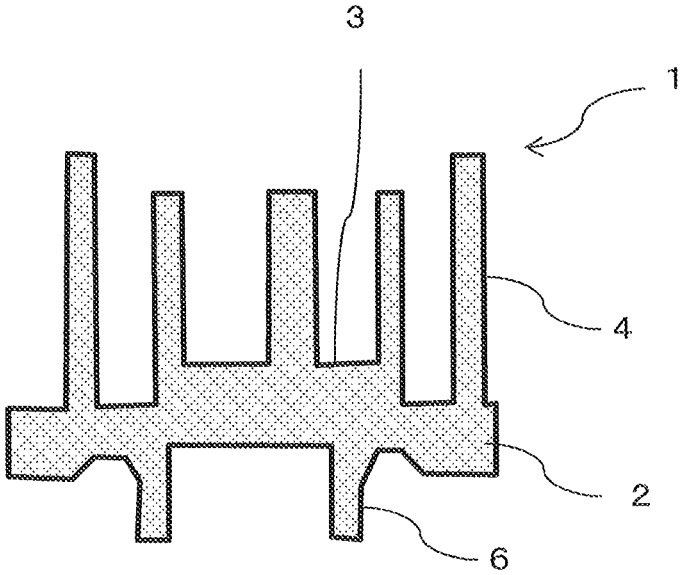
FIG. 1B is a sectional view of FIG. 1A along an A-A' arrow.

FIG. 1A is a perspective view showing the shape of a scroll 1. FIG. 1B is a sectional view of FIG. 1A along an A-A' arrow. The scroll 1 comprises a flange 2 having a step part 3, a fin 4 spirally extending from one end face of the flange 2 and having a step part 5, and a cylindrical mounting part 6 formed on the other end face of the flange 2. In a scroll compressor, these scrolls 1 are combined so that the respective fins 4 face each other, and one scroll 1 is revolved with respect to the other scroll to compress a fluid between the fins 4 of both of the scrolls 1.

Figure 2A:
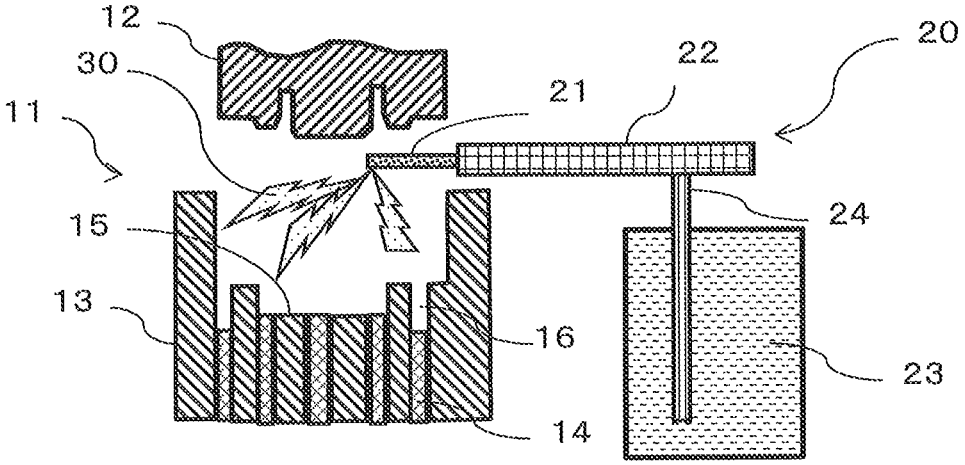
FIGS. 2A to 2C are schematic sectional views of a scroll-specific forging molding apparatus 11 in the present embodiment.
Figure 2B:
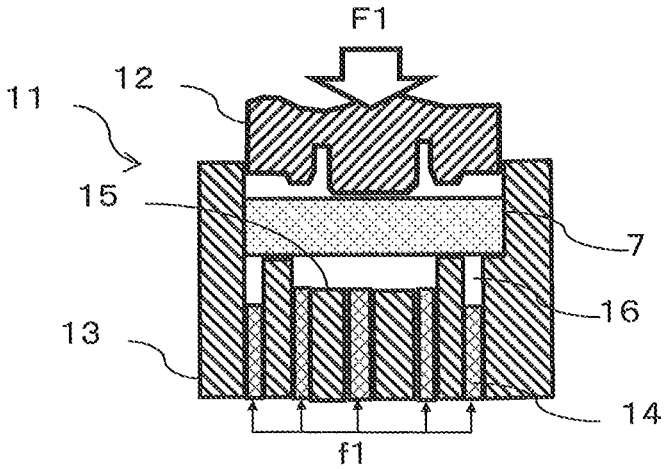
Figure 2C:
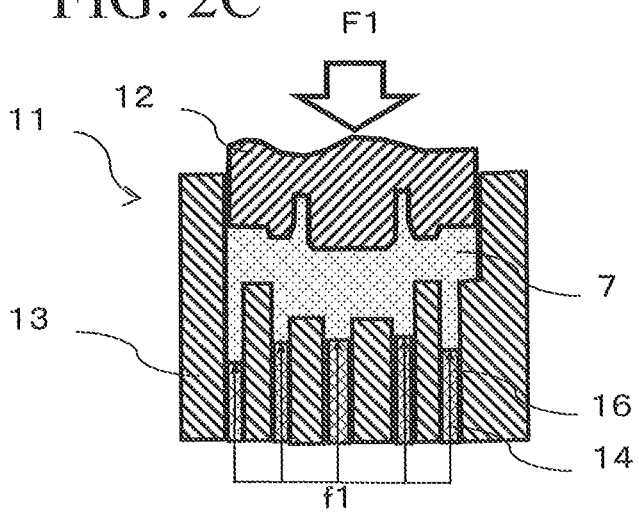

FIGS. 2A to 2C are schematic sectional views of a scroll-specific forging molding apparatus 11 in the present embodiment. By using FIGS. 2A to 2C, a procedure when a scroll is manufactured by forging molding is described. First, a lubricating-oil composition 30 for forging molding is injected from a nozzle 21 of a lubricating-oil-composition spraying device 20 and is sprayed onto a lower mold 13 having a shape formed by transferring a molded body. Next, a disk-shaped forging material 7 is inserted into the lower mold 13, and the forging material 7 is pushed by a punch 12 having a shape formed by transferring a back side shape of the molded body into a fin groove 16 of the lower mold 13. The lower mold 13 has therein a recessed part 15 formed by transferring the shape of the step part 3 of the flange 2, and the spiral-shaped fin groove 16 formed by transferring the shape of the fin 4 and having a back pressure plate 14 placed therein. In the fin groove 16, the back pressure plate 14 is inserted from a back surface side of the lower mold 13. The back pressure plate 14 vertically moves by a spring or hydraulic cylinder not shown to cause a back pressure force f1 exerted on the forging material 7 flowing into the fin groove 16 in a direction opposite to a molding force F1. While the back pressure force f1 in the direction opposite to a direction of pushing the material 7 by the molding force F1 of the punch 12 is being added, the forging material 7 is pushed into the fin groove 16, thereby improving accuracy of the height of the fin being pushed.

The lubricating-oil-composition spraying device 20 is configured of the nozzle 21 for spraying the lubricating-oil composition 30 for forging molding toward the surface of the lower mold 13, a support arm 22 for removably inserting the nozzle 21 between the lower mold 13 and the punch 12, an oil-feeding tank 23 storing the lubricating-oil composition 30 for forging molding, and a supply tube 24 for suctioning the lubricating-oil composition 30 for forging molding from the oil-feeding tank 23 for supply to the nozzle 21. The supply tube 24 comprises a plurality of suction ports for suctioning the lubricating-oil composition 30 for forging molding. While the lubricating-oil composition 30 for forging molding being agitated by an agitating stick (not shown), the supply tube 24 suctions the lubricating-oil composition 30 for forging molding via the plurality of suction ports. The nozzle 21 can multi-directionally inject toward the lower mold 13.

In the lubricating-oil composition for forging molding of the present invention, particles of solid lubricants are dispersed in base oil. When the lubricating-oil composition for forging molding with unbalanced dispersion of particles is sprayed onto the mold, the effect of improving lubricity may not be achieved. To spray the lubricating-oil composition for forging molding with uniform components onto the mold, a structure in which the supply tube 24 is provided with a plurality of suction ports and a structure provided with a nozzle that can multi-directionally inject are preferable. Examples of these are shown in FIGS. 3A and 3B, which are schematic sectional views of the shape of the suction ports at the tip of the supply tube 24 to be inserted into an oil surface 26, and FIG. 4 shows a schematic view of the shape of the nozzle 21.

Figure 3A:
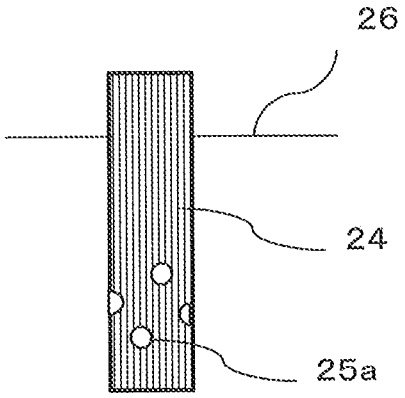
FIGS. 3A and 3B are schematic sectional views of a tip of a supply tube 24 on an oil surface side.
Figure 3B:
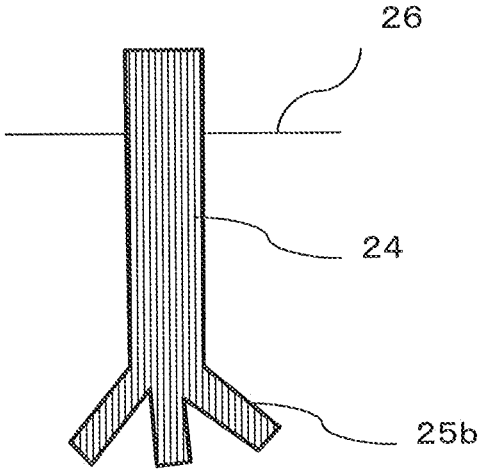

In the example shown in FIG. 3A, a plurality of circular suction ports 25*a* are provided at the tip of the supply tube 24. In the example shown in FIG. 3B, the tip of the supply tube 24 has a shape divided into plural, which forms a suction port 25*b*. With this, the solid lubricant dispersed as particles in the base oil can be easily suctioned, and therefore the lubricating-oil composition for forging molding with uniform components can be supplied.

Figure 4:
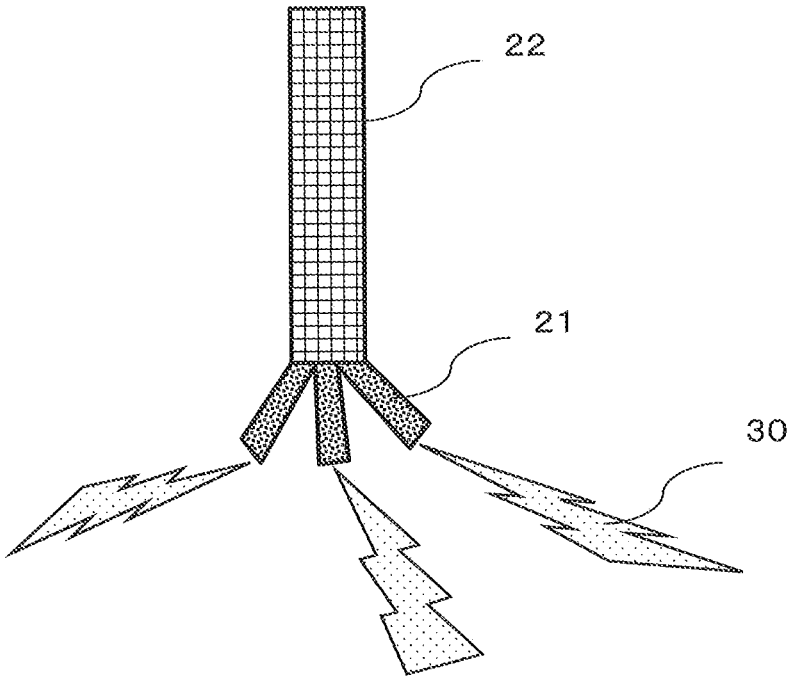
FIG. 4 is a schematic view of the shape of a nozzle.

In the example shown in FIG. 4, a plurality of nozzles 21 are provided. Therefore, injection can be multi-directionally made toward the lower mold 13 having a complex shape. With this, the lower mold 13 can be coated in detail with the lubricating-oil composition 30 for forging molding with uniform components. In FIG. 4, although injection ports of the nozzles are not shown, the shape of each injection port is preferably a circle, an oval, or the like.

When the surface roughness of the forging material of the scroll is 1.6 μm to 6.3 μm on average, PTFE having a particle size equal to or smaller than 1.6 μm and PTFE having a particle size exceeding 1.6 μm are preferably used as the solid lubricants contained in the lubricating-oil composition for forging molding.

Although spraying the lubricating-oil composition 30 for forging molding onto the lower mold 13 has been described by using FIG. 2A to FIG. 4, it goes without saying that the lubricating-oil composition 30 for forging molding is sprayed also onto the punch 12 as required to improve lubricity between the forging material 7 and punch 12.

Examples of the present invention are described below. In the present invention, a friction coefficient is used as an index for evaluating lubricity of the lubricating-oil composition for forging molding. The friction coefficient can be obtained from a ring-compression-type friction test. As the friction coefficient is smaller, lubricity is better. A ring-compression-type friction test method is as follows.

<Ring-Compression-Type Friction Tests>

A ring-shaped test piece with a shape having an inner diameter 15 mm, an outer diameter of 30 mm, and a height of 10 mm and made of an aluminum alloy (AD8C under JIS) was prepared. By using a ring-compression test machine formed of paired upper and lower molds, the ring-shaped test piece was compressed with the surfaces of the molds coated with the lubricating-oil composition for forging molding, and a friction coefficient was found from an inner-diameter reduction ratio of the ring-shaped test piece after compression.

Test conditions are as follows.

Apparatus

Hydraulic press machine: Asai EFP150

Molds: upper and lower plates of ϕ80 mm

Test Conditions

Temperature: 450° C. (the temperature of the test piece just after the pressing)

Compressibility ratio: 45%

Fall velocity: 7.5 mm/s

Oil coating amount: 0.3 g (to coat the upper and lower molds)

FIRST EXAMPLE

Materials shown in Table 1 were weighed, mixed, and agitated to prepare lubricating-oil compositions for forging molding with compositions shown in Table 1 (Test Samples 1 to 7). By using the obtained lubricating-oil compositions for forging molding, ring-compression-type friction tests were conducted to obtain friction coefficients. Values of friction coefficients are shown in Table 1.

Note in Table 1 that PTFE (0.2 μm to 0.3 μm) means PTFE having a particle size of 0.2 μm to 0.3 μm, PTFE (7 μm) means PTFE having a particle size of 7 and PTFE (15 μm) means PTFE having a particle size of 15 μm. Zn-DTP (C8) means Zn-DTP having a carbon number of the alkyl group of 8, Zn-DTP (C10) means Zn-DTP having a carbon number of the alkyl group of 10, and Zn-DTP (C12) means Zn-DTP having a carbon number of the alkyl group of 12. PIB means polyisobutylene.

Also, for comparison, ring-compression-type friction tests were conducted by using commercially-available graphite-based and non-graphite-based lubricants that are conventionally used as lubricants to obtain friction coefficients. The friction coefficients were 0.11 for the graphite-based lubricant and 0.18 for the non-graphite-based lubricant. Furthermore, under no lubrication condition, the friction coefficient was 0.35.

From Table 1, the following was found. Test Sample 5 without addition of a solid lubricant and Test Samples 1, 2, and 3 using a solid lubricant having one type of particle size were inferior in lubricity to the graphite-based lubricant. Test Samples 4, 6, and 7 using solid lubricants having two types of particle sizes had friction coefficients equivalent to or lower than that of the graphite-based lubricant, and therefore were excellent in lubricity. When attention is focused on Test Samples 4, 6, and 7, when 5% solid lubricants are added, the friction coefficient is small and lubricity is excellent and, from the fact that a change in friction coefficient is small between 5% to 10%, it can be found that the effect of improving lubricity is saturated when the amount of the solid lubricants exceeds 5%. Also, while Test Sample 6 with a total amount of solid lubricants being 3% has a low friction coefficient compared with Test Sample 5 without addition of a solid lubricant, it has a high friction coefficient compared with Test Sample 4 with a total amount thereof being 5%. To sufficiently obtain the effect of decreasing the friction coefficient, the total amount of solid lubricants is preferably 4% or more.

TABLE 1

| | | SAMPLE 1 | SAMPLE 2 | SAMPLE 3 | SAMPLE 4 | SAMPLE 5 | SAMPLE 6 | SAMPLE 7 |
|---|---|---|---|---|---|---|---|---|
| BASE OIL | MINERAL OIL | Bal. | Bal. | Bal. | Bal. | Bal. | Bal. | Bal. |
| | RAPESEED OIL | 25 | 25 | 25 | 25 | 25 | 25 | 25 |
| SOLID LUBRICANT | PTFE (0.2 to 0.3 μm) | 5 | — | — | 2.5 | — | 1.5 | 5 |
| | PTFE (7 μm) | — | 5 | — | 2.5 | — | 1.5 | 5 |
| | PTFE (15 μm) | — | — | 5 | — | — | — | — |
| EXTREME-PRESSURE AGENT | Zn-DTP (C8) | — | — | — | — | — | — | — |
| | Zn-DTP (C10) | 10 | 10 | 10 | 10 | 10 | 10 | 10 |
| | Zn-DTP (C12) | — | — | — | — | — | — | — |
| DISPERSANT | PIB | 3 | 3 | 3 | 3 | 3 | 3 | 3 |
| FRICTION COEFFICIENT | | 0.121 | 0.134 | 0.133 | 0.097 | 0.149 | 0.124 | 0.101 |

SECOND EXAMPLE

Figure 5:
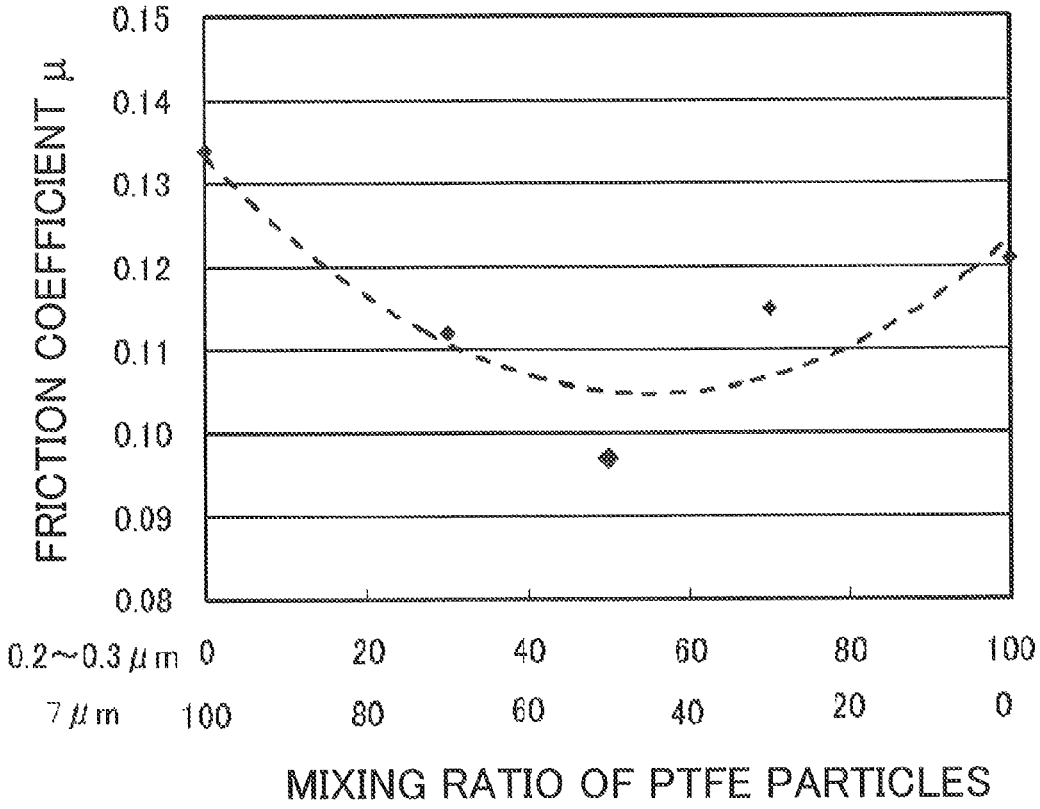
FIG. 5 is a graph that shows a relation between a mixing ratio of PTFE having a particle size of 0.2 μm to 0.3 μm and PTFE having a particle size of 7 μm and a friction coefficient

As solid lubricants, three types of PTFE particles having different particle sizes of 0.2 μm to 0.3 μm, 7 μm, and 15 μm were prepared to examine the effect of improving lubricity by changing a mixing ratio of the PTFE particles having different particle sizes. A lubricating-oil composition for forging molding having a composition shown in Table 2 was prepared, ring-compression-type friction tests were conducted, and friction coefficients were obtained (Test Samples 8, 9, 10, and 11). The results are shown in Table 2. Also, regarding Test Samples 1, 2, and 4 of the first example and Test Samples 8 and 9 of the second example, a mixing ratio of PTFE having a particle size of 0.2 μm to 0.3 μm and PTFE having a particle size of 7 μm and the friction coefficient is shown in FIG. 5.

Note that the mixing ratio of PTFEs was calculated from a mixing amount of PTFEs. For example, in Table 2, a mixing ratio of 1.5% PTFE (0.2 μm to 0.3 μm) and 3.5% PTFE (7 μm) is PTFE (0.2 μm to 0.3 μm):PTFE (7 μm)=30:70 in FIG. 5. Also, in FIG. 5, a broken line indicates an approximation curve.

TABLE 2

| | | SAMPLE 8 | SAMPLE 9 | SAMPLE 10 | SAMPLE 11 |
|---|---|---|---|---|---|
| BASE OIL | MINERAL OIL | Bal. | Bal. | Bal. | Bal. |
| | RAPESEED OIL | 25 | 25 | 25 | 25 |
| SOLID LUBRICANT | PTFE (0.2 to 0.3 μm) | 1.5 | 3.5 | 2.5 | — |
| | PTFE(7 μm) | 3.5 | 1.5 | — | 2.5 |
| | PTFE(15 μm) | — | — | 2.5 | 2.5 |
| EXTREME-PRESSURE AGENT | Zn-DTP (C8) | — | — | — | — |
| | Zn-DTP (C10) | 10 | 10 | 10 | 10 |
| | Zn-DTP (C12) | — | — | — | — |
| DISPERSANT | PIB | 3 | 3 | 3 | 3 |
| FRICTION COEFFICIENT | | 0.112 | 0.102 | 0.107 | 0.114 |

From Table 2, it was found that by mixing two types of PTFE particles, the friction coefficient is decreased, that is, lubricity is improved. From FIG. 5, with a mixing ratio of 50:50 as a peak, the friction coefficient is decreased over an entire mixing ratio range, and the effect of improving lubricity by mixing two types of PTFE particles can be confirmed.

THIRD EXAMPLE

Figure 6:
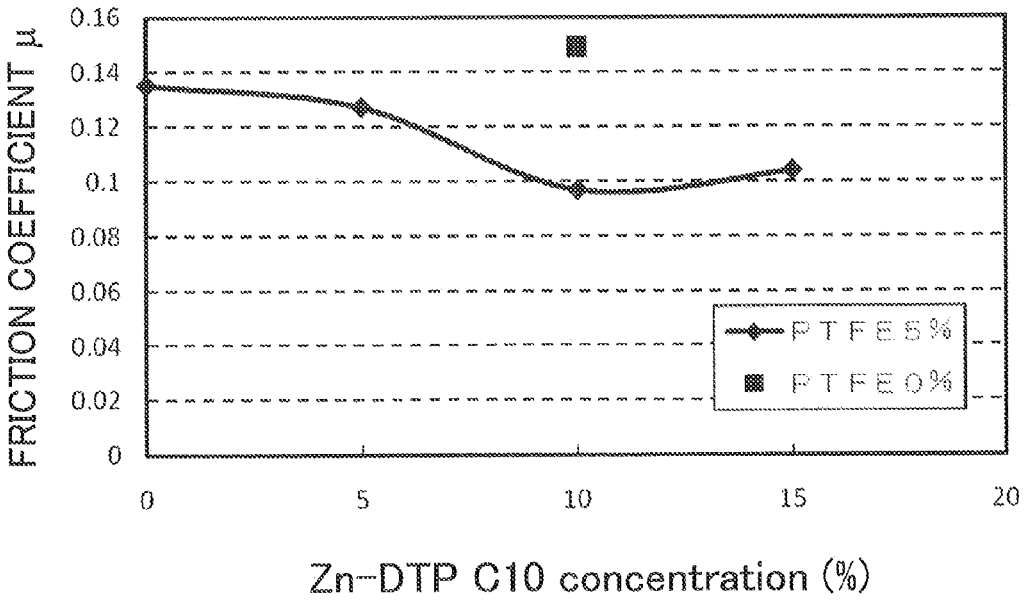
FIG. 6 is a graph that shows a relation between an addition amount of Zn-DTP (extreme-pressure agent) and a friction coefficient.

A lubricating-oil composition for forging molding made of 5% PTFE (solid lubricant) with a mixing ratio of PTFE (0.2 μm to 0.3 μm):PTFE (7 μm)=50:50, 0% to 15% Zn-DTP (extreme-pressure agent) having a carbon number of the alkyl group of 10, 3% PIB, 25% rapeseed oil, and the balance of mineral oil was prepared, ring-compression-type friction tests were conducted, and friction coefficients were obtained (Test Samples 12, 13, and 14). The compositions and friction coefficients of Test Samples 4, 12, 13, and 14 are shown in Table 3, and changes in friction coefficient with respect to concentration of Zn-DTP (extreme-pressure agent) are shown in FIG. 6.

Also, for comparison, a lubricating-oil composition for forging molding made of 0% PTFE (solid lubricant), 10% Zn-DTP (extreme-pressure agent) having a carbon number of the alkyl group of 10, 3% PIB, 25% rapeseed oil, and the balance of mineral oil was prepared (Test Sample 15), a ring-compression-type friction tests was conducted, and a friction coefficient was obtained. The results are also shown in Table 3 and FIG. 6.

TABLE 3

| | | SAMPLE 12 | SAMPLE 13 | SAMPLE 4 | SAMPLE 14 | SAMPLE 15 |
|---|---|---|---|---|---|---|
| BASE OIL | MINERAL OIL | Bal. | Bal. | Bal. | Bal. | Bal. |
| | RAPESEED OIL | 25 | 25 | 25 | 25 | 25 |
| SOLID LUBRICANT | PTFE (0.2 to 0.3 μm) | 2.5 | 2.5 | 2.5 | 2.5 | — |
| | PTFE (7 μm) | 2.5 | 2.5 | 2.5 | 2.5 | — |
| | PTFE (15 μm) | — | — | — | — | — |
| EXTREME-PRESSURE AGENT | Zn-DTP (C8) | — | — | — | — | — |
| | Zn-DTP (C10) | 0 | 5 | 10 | 15 | 10 |
| | Zn-DTP (C12) | — | — | — | — | — |
| DISPERSANT | PIB | 3 | 3 | 3 | 3 | 3 |
| FRICTION COEFFICIENT | | 0.135 | 0.127 | 0.097 | 0.104 | 0.149 |

From Table 3 and FIG. 6, it can be found that when Zn-DTP having a carbon number of the alkyl group of 10 is used as an extreme-pressure agent, the friction coefficient is decreased, that is, lubricity is improved, with 5% or more addition. Also, when attention is focused on Test Sample 15, the friction coefficient is not decreased in the case where PTFE is not added while Zn-DTP is added. Therefore, it can be confirmed that the effect of improving lubricity with combined addition of the solid lubricants and the extreme-pressure agent is exhibited.

FOURTH EXAMPLE

A lubricating-oil composition for forging molding made of 5% PTFE (solid lubricant) with a mixing ratio of PTFE (0.2 μm to 0.3 μm):PTFE (7 μm)=50:50, 10% Zn-DTP (extreme-pressure agent) having a carbon number of the alkyl group of 8 and 12, 3% PIB, 25% rapeseed oil, and the balance of mineral oil was prepared, ring-compression-type friction tests were conducted, and friction coefficients were obtained (Test Samples 16 and 17). The compositions and friction coefficients of Test Samples 4, 16, and 17 are shown in Table 4, and changes in friction coefficient with respect to the carbon numbers of Test Samples 4, 16, and 17 are shown in FIG. 7.

TABLE 4

| | | SAMPLE 16 | SAMPLE 4 | SAMPLE 17 |
|---|---|---|---|---|
| BASE OIL | MINERAL OIL | Bal. | Bal. | Bal. |
| | RAPESEED OIL | 25 | 25 | 25 |
| SOLID LUBRICANT | PTFE (0.2 to 0.3 μm) | 2.5 | 2.5 | 2.5 |
| | PTFE(7 μm) | 2.5 | 2.5 | 2.5 |
| | PTFE(15 μm) | — | — | — |
| EXTREME-PRESSURE AGENT | Zn-DTP (C8) | 10 | — | — |
| | Zn-DTP (C10) | — | 10 | — |
| | Zn-DTP (C12) | — | — | 10 |
| DISPERSANT | PIB | 3 | 3 | 3 |
| FRICTION COEFFICIENT | | 0.104 | 0.097 | 0.122 |

Figure 7:
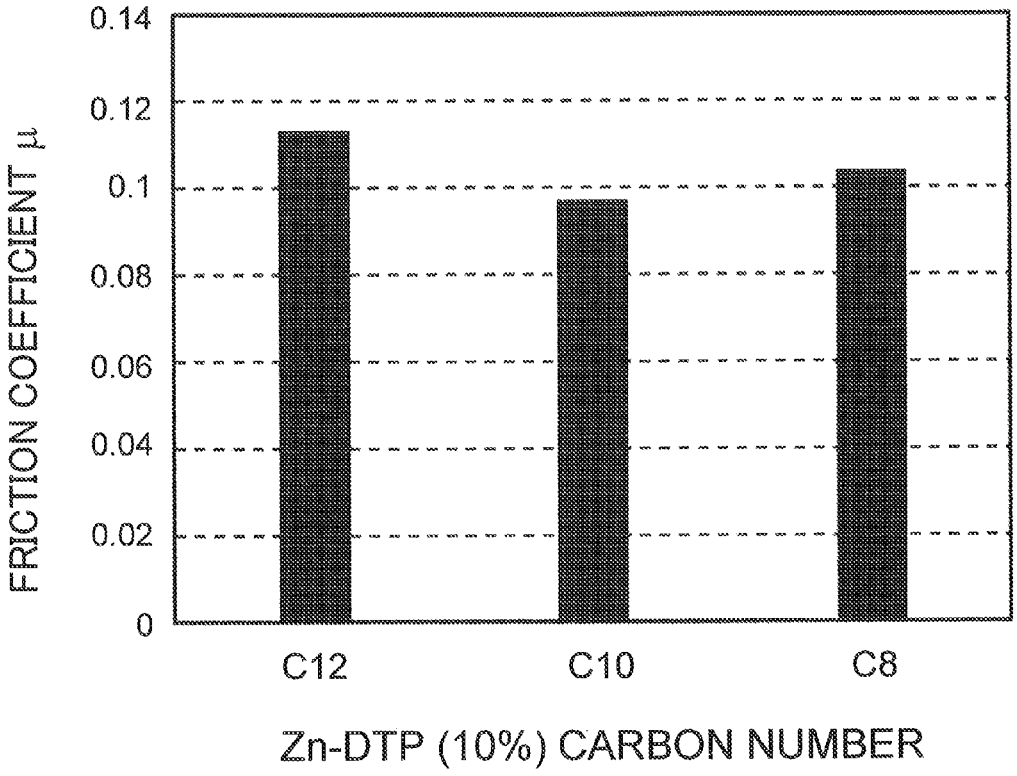
FIG. 7 is a graph that shows a carbon number of an alkyl group contained in Zn-DTP (extreme-pressure agent) and a friction coefficient.

From FIG. 7, it has been confirmed that an effect of reducing the friction coefficient, that is, improving lubricity, can be obtained even if the carbon number of the alkyl group contained in Zn-DTP is changed.

The lubricating-oil composition for forging molding in which PTFE as a solid lubricant and Zn-DTP as an extreme-pressure agent were used has been described in the embodiment described above. Other than the above, the configurations cited in the above described embodiment can be selected or omitted, or can be arbitrarily changed to the other configurations, without departing from the gist of the present invention.

REFERENCE SIGNS LIST

1 . . . scroll
7 . . . forging material
11 . . . forging molding apparatus
12 . . . punch
13 . . . lower mold
20 . . . lubricating-oil-composition spraying device
21 . . . nozzle
24 . . . supply tube
25*a* . . . suction port
25*b* . . . suction port
30 . . . lubricating-oil composition for forging molding

The invention claimed is:

1. A lubricating-oil composition for forging molding comprising at least two types of solid lubricants having different particle sizes, an extreme-pressure agent, and the balance of base oil, wherein the solid lubricants comprise fluororesin having different particle sizes, and the lubricating-oil composition consists essentially of 0.1 wt % to 15 wt % of the fluororesin, 5 wt % to 15 wt % of the extreme-pressure agent, 5 wt % or less of a dispersant, and the balance of base oil.

2. The lubricating-oil composition for forging molding according to claim 1, comprising 4 wt % to 15 wt % of the fluororesin and 5 wt % to 15 wt % of the extreme-pressure agent.

3. The lubricating-oil composition for forging molding according to claim 1, wherein the extreme-pressure agent comprises zinc dialkyl dithio phosphate.

4. The lubricating-oil composition for forging molding according to claim 1, wherein among said at least two types of solid lubricants having different particle sizes, at least one type of solid lubricant has a particle size smaller than a minimum surface roughness of a forging material.

5. The lubricating-oil composition for forging molding according to claim 1, wherein the solid lubricants are formed of a polytetrafluoroethylene having a particle size equal to or smaller than 6 μm and a polytetrafluoroethylene having a particle size exceeding 6 μm and equal to or smaller than 15 μm.

* * * * *